US008096345B2

(12) United States Patent
Ozaki et al.

(10) Patent No.: US 8,096,345 B2
(45) Date of Patent: Jan. 17, 2012

(54) METHOD AND APPARATUS FOR PRODUCING AMORPHOUS RIBBON

(75) Inventors: Shigekatsu Ozaki, Tokyo (JP); Takeshi Imai, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 183 days.

(21) Appl. No.: 12/451,314

(22) PCT Filed: Apr. 16, 2008

(86) PCT No.: PCT/JP2008/057784

§ 371 (c)(1),
(2), (4) Date: Nov. 4, 2009

(87) PCT Pub. No.: WO2008/139858

PCT Pub. Date: Nov. 20, 2008

(65) Prior Publication Data

US 2010/0132907 A1 Jun. 3, 2010

(30) Foreign Application Priority Data

May 8, 2007 (JP) ..... 2007-123323
May 8, 2007 (JP) ..... 2007-123424

(51) Int. Cl.
*B22D 11/06* (2006.01)

(52) U.S. Cl. ..... 164/463; 164/423; 164/479

(58) Field of Classification Search ..... 164/463, 164/423, 428–429, 479–480
See application file for complete search history.

(56) References Cited

U.S. PATENT DOCUMENTS 4,708,194 A * 11/1987 Mohn ..... 164/463
2006/0237162 A1* 10/2006 Schlichting et al. ..... 164/480

FOREIGN PATENT DOCUMENTS

| | | |
|---|---|---|
| JP | 58-029557 | 2/1983 |
| JP | 59-229263 | 12/1984 |
| JP | 61-209755 | 9/1986 |
| JP | 62-166059 | 7/1987 |
| JP | 62-176650 | 8/1987 |
| JP | 63-090341 | 4/1988 |
| JP | 63-090343 | 4/1988 |
| JP | 03-169460 | 7/1991 |
| JP | 3-234337 | 10/1991 |
| JP | 03-275252 | 12/1991 |
| JP | 07-178516 | 7/1995 |
| JP | 07-178517 | 7/1995 |
| JP | 08-019834 | 1/1996 |
| JP | 2006-281317 | 10/2006 |

OTHER PUBLICATIONS

International Search Report dated Jun. 24, 2008 issued in corresponding PCT Application No. PCT/JP2008/057784.

* cited by examiner

*Primary Examiner* — Kuang Lin
(74) *Attorney, Agent, or Firm* — Kenyon & Kenyon LLP

(57) ABSTRACT

A method and apparatus are provided for producing an amorphous ribbon by ejecting and rapidly solidifying molten alloy on a circumferential surface of a rapidly rotating cooling roll, wherein the cooling roll is polished online during amorphous ribbon production. When the circumferential surface of the cooling roll after peeling off the ribbon is polished using a polishing member, the circumferential surface of the cooling roll is polished continuously or intermittently across its lateral direction while differentiating the polishing mode in accordance with the surface properties.

4 Claims, 8 Drawing Sheets

METHOD AND APPARATUS FOR PRODUCING AMORPHOUS RIBBON

This application is a national stage application of International Application No. PCT/JP2008/057784, filed 16 Apr. 2008, which claims priority to Japanese Application Nos. 2007-123323, filed 08 May 2007; and 2007-123424, filed 08 May 2007, each of which is incorporated by reference in its entirety.

FIELD OF THE INVENTION

This invention relates to a method and an apparatus for producing an amorphous ribbon by ejecting molten alloy onto a cooling roll to be rapidly cooled and solidified, and particularly to such a method and an apparatus that polish the cooling roll online during amorphous ribbon production.

DESCRIPTION OF THE RELATED ART

The production method generally used to produce amorphous ribbon is the single roll method in which the molten alloy is usually ejected onto the circumferential surface of a cooling roll rotating at high speed to cool and solidify the molten alloy rapidly by the heat removing action of the cooling roll.

In the single roll method, the molten alloy must be rapidly cooled at a cooling rate of around $10^4$ to $10^{5}$° C./s. A cooling roll made of copper alloy or other metal material of large thermal conductivity is therefore ordinarily used as a cooling roll that can rapidly remove heat from the molten alloy.

In industrial production, the amorphous ribbon obtained by rapidly cooling the molten alloy on the cooling roll is continuously coiled as it is peeled off the cooling roll. Since the molten alloy comes in direct contact with the cooling roll, the surface of the cooling roll sustains damage as the production proceeds owing to the heat history, solidification of the molten alloy and other causes, thereby increasing the roughness of the cooling roll surface and degrading the material of its surface layer. These phenomena adversely impact the surface properties, magnetic properties and the like of the amorphous ribbon and may on occasion cause fracture of the amorphous ribbon during production.

Therefore, when industrially producing an amorphous ribbon, prolonged maintenance of the circumferential surface of the cooling roll in prime condition is essential both for ensuring the productivity of the amorphous ribbon and for maintaining its magnetic properties uniform. This has led to various proposals for polishing the surface of the cooling roll (see Japanese Patent Publications (A) Nos. S58-025848, S58-029557, S61-209755, S62-166059, S62-176650, S63-090341, S63-090343, H03-169460, H03-275252, H07-178516, H07-178517, and H08-019834).

For example, Publication (A) No. S61-209755 teaches a polishing method that uses a cup brush or rotary brush to polish the surface of the cooling roll in a direction making an angle of 15° or greater relative to the longitudinal direction of the ribbon.

Publication (A) No. S62-176650 teaches a cooling roll surface cleaner having multiple brush rolls installed at the cooling roll circumferential surface for removing extraneous material stuck on the circumferential surface.

Publication (A) No. S63-090343 teaches a method of polishing the cooling roll surface that uses a spring mechanism to press four types of emery paper of differing granularity onto the circumferential surface of the cooling roll in the order of decreasing granularity.

Publication (A) No. H03-169460 teaches a method of polishing or grinding based on the output of an online measurement unit installed to measure cooling roll surface roughness. Publications (A) Nos. H07-178516 and H07-178517 teach methods of polishing the cooling roll surface with a brush roll and removing the polishing dust and brush debris generated by the polishing with a comb-blade-shaped scraper.

However, the methods taught by Japanese Patent Publications (A) Nos. S58-025848, S58-029557, S61-209755, S62-166059, S62-176650, S63-090341, S63-090343, H03-169460, H03-275252, H07-178516, H07-178517, and H08-019834 are all based on the assumption that the amount of damage arising on the circumferential surface of the cooling roll during amorphous ribbon production is substantially uniform in the lateral direction of the cooling roll. This means that these methods cannot polish the circumferential surface of the cooling roll to a prime condition when the amount of damage sustained by the circumferential surface varies in the lateral direction of the cooling roll.

Industrial production of amorphous ribbon excellent in magnetic properties requires that the circumferential surface of the cooling roll be constantly maintained in prime condition over a prolonged period. A need has therefore been felt for the development of a technology enabling the circumferential surface of a cooling roll to be constantly polished to prime condition even when the amount of damage varies in the lateral direction of the cooling roll.

SUMMARY OF THE INVENTION

The problem sought to be solved in the achievement of the present invention was to enable the circumferential surface of a cooling roll used to produce amorphous ribbon to be polished online in the lateral direction of the cooling roll during the production so as to maintain the circumferential surface in prime condition over a prolonged period. The purpose of the present invention is to provide a production method and a production apparatus that enable mass production of amorphous ribbon excellent in magnetic properties.

As a first step in their development of a method for maintaining the circumferential surface of a cooling roll in prime condition over a prolonged period during production of amorphous ribbon, the inventors made an in-depth study of the nature of the damage that occurs on cooling roll circumferential surfaces.

This study revealed that (i) when the ribbon on the cooling roll is contracted by solidification of the molten alloy, solidified portions invading minute recesses in the cooling roll surface scrape and produce scratches on the cooling roll surface, (ii) the contraction of the ribbon is greatest at the laterally opposite edges of the ribbon, and (iii) with passage of time, the regions of the circumferential surface of the cooling roll in contact with the opposite edge regions of the ribbon come to be more heavily damaged than the middle region.

It was also discovered that the cooling roll circumferential surface whose amount of damage differs between the regions associated with the middle and the opposite edges of the ribbon can be constantly maintained in prime condition during ribbon production by, during the lateral polishing of the circumferential surface of the cooling roll from which the amorphous ribbon has been removed, differentiating polishing mode in the direction of cooling roll rotation, i.e., installing and polishing with polishing members having different polishing characteristics.

The present invention was accomplished based on the foregoing knowledge and the gist thereof is as set out below.

(1) A method for producing an amorphous ribbon by ejecting and rapidly solidifying molten alloy on a circumferential surface of a rapidly rotating cooling roll, which method comprises: in the course of the ribbon production, using a polishing member to polish a circumferential surface of the cooling roll from which the ribbon has been peeled; and during the polishing, conducting continuous or intermittent polishing across the lateral direction of the circumferential surface of the cooling roll while differentiating the polishing mode in accordance with the surface properties.

(2) A method for producing an amorphous ribbon according to (1), wherein lateral segments of the cooling roll are polished by polishing members arranged in parallel.

(3) A method for producing an amorphous ribbon according to (1), wherein part or all of the polishing is conducted stepwise in the circumferential direction of the cooling roll.

(4) A method for producing an amorphous ribbon according to (1), wherein the polishing mode is differentiated using at least two polishing members having different polishing characteristics.

(5) A method for producing an amorphous ribbon according to (1) or (4), wherein polishing is conducted using in combination two types of polishing members selected from among a cylindrical brush roll made of a polishing material constituted by braiding abrasive grains into a resin fiber rod, an abrasive pad, an abrasive paper and an abrasive belt.

(6) A method for producing an amorphous ribbon according to (1), wherein the factor differentiating the polishing mode is one among the material, shape, abrasive grit size, hardness, density (number of polishing elements per unit area), contact area, and pressing force of the polishing member.

(7) A method for producing an amorphous ribbon according to any of (1) to (6), wherein at least two polishing members having different polishing characteristics are aligned in the direction of cooling roll rotation and the polishing of the circumferential surface of the cooling roll is conducted with the polishing members in contact with the circumferential surface of the cooling roll over a length equal to 0.2% or greater of the cooling roll circumference.

(8) A method for producing an amorphous ribbon according to (1), wherein the cooling roll is cleaned after completion of the polishing.

(9) An apparatus for producing an amorphous ribbon by ejecting and rapidly solidifying molten alloy on a circumferential surface of a rapidly rotating cooling roll, which apparatus comprises: a polishing member installed on the cooling roll outer periphery between a produced ribbon peeling location and a molten metal ejecting location, which polishing member is differentiated in polishing mode in the lateral direction of the cooling roll.

(10) An apparatus for producing an amorphous ribbon according to (9), wherein the polishing member is installed in segments in the lateral direction of the cooling roll.

(11) An apparatus for producing an amorphous ribbon according to (9) or (10), wherein the polishing member is a combination of one or more types selected from among a cylindrical brush roll made of a polishing material constituted by incorporating abrasive grains into a woven resin fiber rod, an abrasive pad, an abrasive paper and an abrasive belt.

(12) An apparatus for producing an amorphous ribbon according to any of (9) to (11), wherein at least two polishing members having different polishing characteristics are arranged in the direction of cooling roll rotation partially or throughout the cooling roll lateral direction and the polishing members are installed to make contact with the circumferential surface of the cooling roll over a length equal to 0.2% or greater of the cooling roll circumference.

(13) An apparatus for producing an amorphous ribbon according to (9), further comprising a cleaning unit for cleaning the cooling roll installed immediately after the polishing members.

BRIEF DESCRIPTION OF THE DRAWINGS

FIG. 2(*b*) is a diagram showing how roughness (roughness ratio where preproduction cooling roll roughness is defined as 1) changed with production time at the middle region and the contact edges (ribbon edges) of the cooling roll when, in the course of amorphous ribbon production, two polishers were used and the contact length (polishing length) L between the polishers and the circumferential surface of the cooling roll was varied.

FIG. 3(*b*) is a diagram showing another configuration of a single-roll apparatus for manufacturing amorphous ribbon in accordance with the present invention.

FIG. 3(*c*) is a diagram showing still another configuration of a single-roll apparatus for manufacturing amorphous ribbon in accordance with the present invention.

DETAILED DESCRIPTION OF THE INVENTION

The present invention will be explained in detail.

Damage to the circumferential surface of a cooling roll during the production of amorphous ribbon markedly impacts the surface and magnetic properties of the amorphous ribbon. Therefore, focusing on the fact that changes in the surface roughness of the cooling roll strongly affect the surface and magnetic properties of the amorphous ribbon, the inventors conducted a study into the nature of damage occurrence from which they learned as follows.

Figure 1:
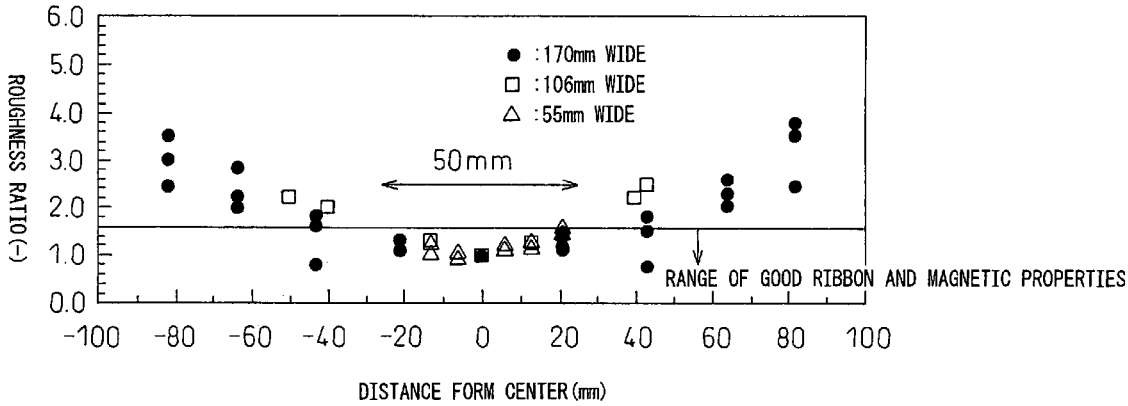
FIG. 1 is diagram showing the change in roughness across a cooling roll (roughness ratio where middle region roughness is defined as 1) after continuously producing amorphous ribbon for 20 min without polishing the circumferential surface of the cooling roll.

When the circumferential surface of the cooling roll is not polished, its roughness varies in the lateral direction as shown in FIG. 1 in the course of production.

FIG. 1 shows the roughness variance in the lateral direction of a cooling roll observed for each of three amorphous ribbons produced. Specifically, it was found that roughness of the circumferential surface of the cooling roll contacted by the molten alloy grew progressively larger than that at the middle region with increasing proximity to the contact edges (ribbon edges).

It was further found that the difference in roughness between the middle region and the contact edges (ribbon edges) increased with increasing width of the amorphous ribbon and was pronounced in amorphous ribbons of 50 mm and greater width.

Through an assiduous analysis of the cause behind these findings, the inventors learned that thermal contraction occurring in the lateral direction of the cooling roll at the time of molten alloy solidification gives rise to a phenomenon by which the middle region and contact edges (ribbon edges) of the cooling roll develop a difference in surface roughness that becomes progressively larger as the production of the amorphous ribbon proceeds. More specifically, when the molten alloy on the cooling roll surface solidifies, it contracts on the cooling roll. At this time, pieces of already solidified alloy lodged in minute recesses in the cooling roll surface are pulled toward the middle region of the cooling roll, causing the solidified alloy to scratch the surface of the cooling roll and thereby damage and coarsen the surface.

Once the cooling roll surface has sustained damage, the molten alloy can easily invade the damage sites, so that the damage to the cooling roll accelerates as production proceeds.

At the time of solidification, the molten alloy thermally contracts in both the lateral and longitudinal directions of the cooling roll. However, the amount of thermal contraction in the longitudinal direction of the cooling roll (direction of cooling roll rotation) is even because the width of the supplied molten alloy is substantially constant and the amount thereof is small because the width of the molten alloy in the longitudinal direction is narrow (not more than several millimeters). As a result, the degree of coarsening of the cooling roll by thermal contraction in the longitudinal direction is also substantially even and the amount of coarsening of the cooling roll by the thermal contraction is small.

In contrast, the contraction in the lateral direction of the cooling roll is greater at the contact edges (ribbon edges) than at the middle region, so that the degree of surface damage is greater at and near the contact edges (ribbon edges) than at the middle region.

The inventors ascertained that this phenomenon appears strongly when production of an amorphous ribbon of 50 mm or greater width is continued for 5 or more minutes without polishing the circumferential surface of the cooling roll.

Figure 2A:
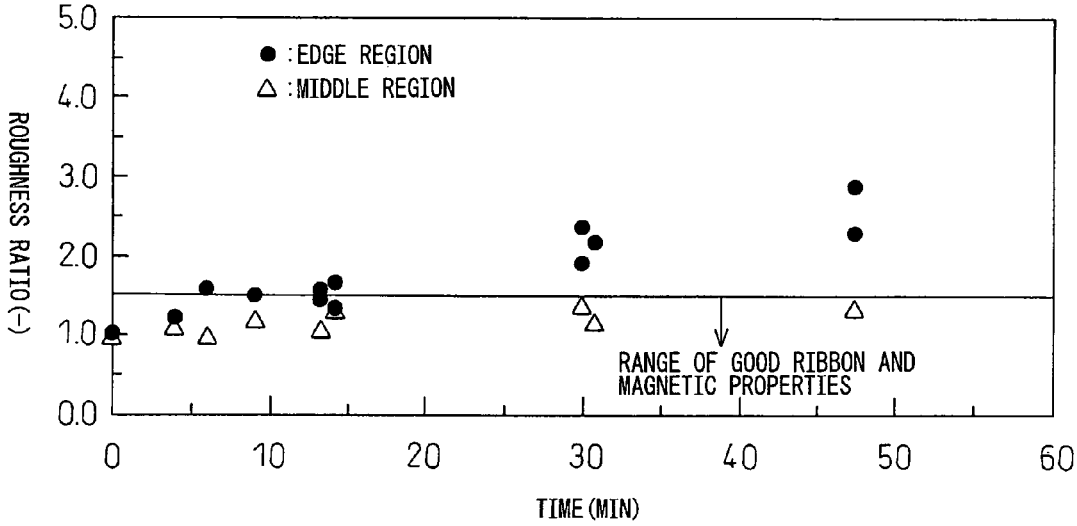
FIG. 2(*a*) is a diagram showing how roughness (roughness ratio where preproduction cooling roll roughness is defined as 1) changed with production time at the middle region and the contact edges (ribbon edges) of a cooling roll when amorphous ribbon was produced without polishing the circumferential surface of the cooling roll.
Figure 2B:
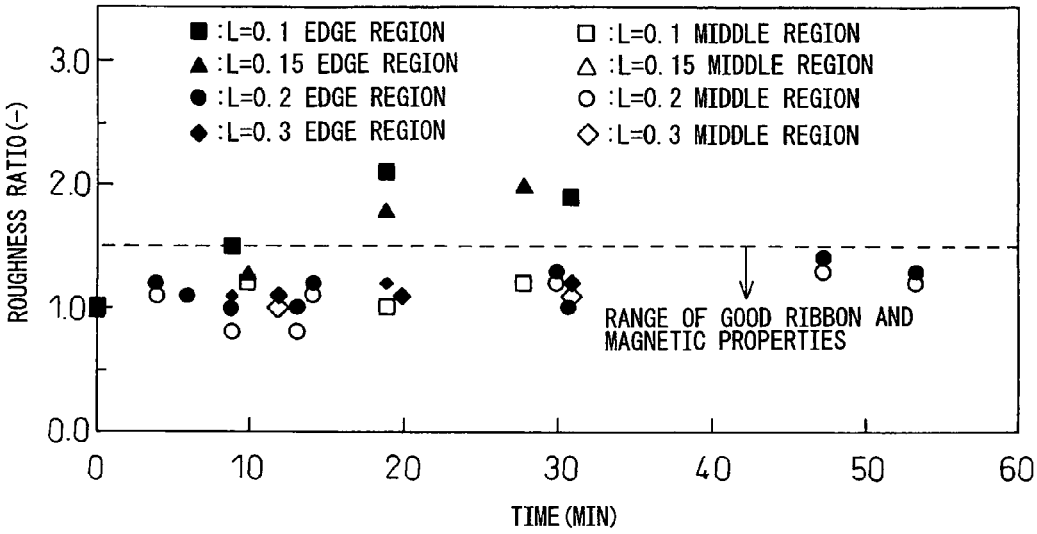

FIG. 2(*a*) shows how the roughness of the middle region and contact edges (ribbon edges) of the cooling roll changed with production time when 106 mm wide amorphous ribbon was produced without polishing the circumferential surface of the cooling roll. Although damage at the middle region (designated by the symbol A in the drawing) changed little even when the production time was prolonged, damage at the contact edges (ribbon edges) (symbol • in the drawing) increased and the ribbon properties and magnetic properties deteriorated when production was continued for 5 min or more.

Figure 3A:
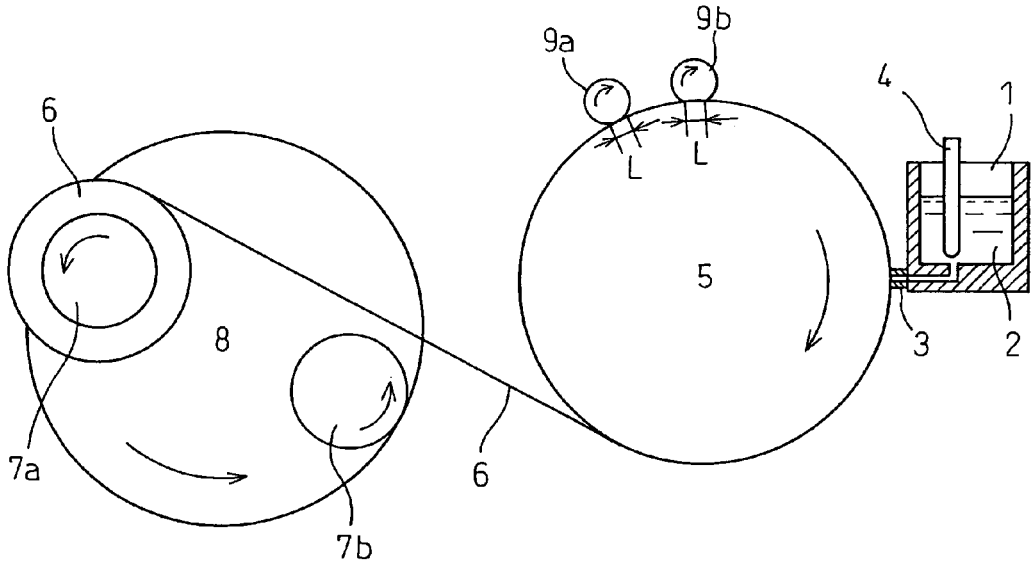
FIG. 3(*a*) is a diagram showing a configuration of a single-roll apparatus for manufacturing amorphous ribbon in accordance with the present invention.
Figure 3B:
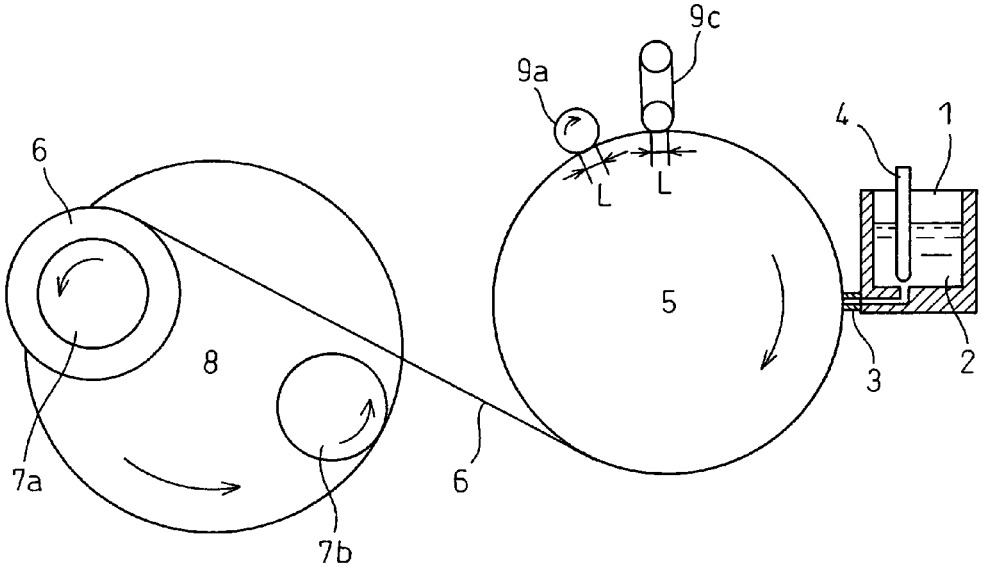
Figure 3C:
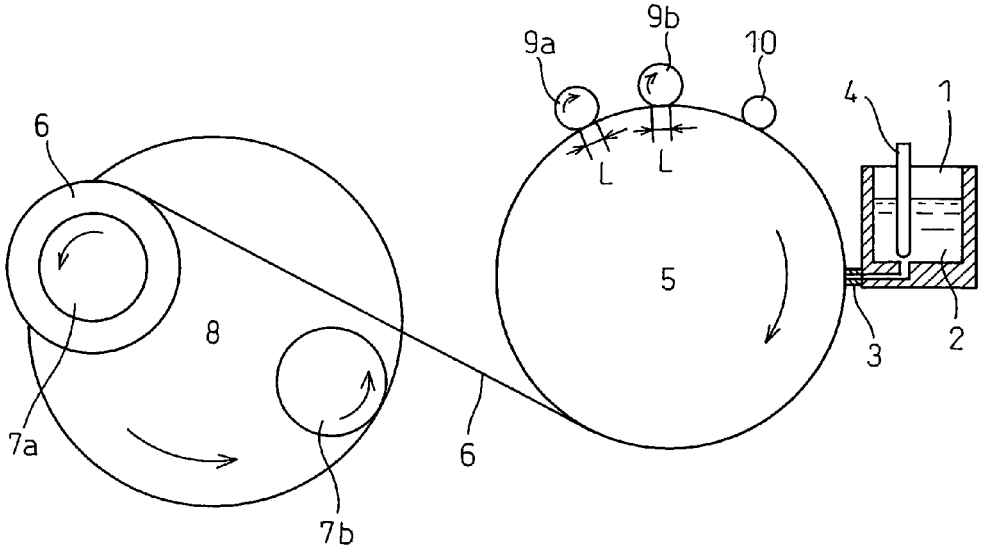

The single-roll apparatus shown in FIG. 3(*a*) is equipped with two polishers 9*a* and 9*b* spaced apart in the direction of cooling roll rotation. Each of the polishers 9*a* and 9*b* constantly contacts the circumferential surface of the cooling roll over a length L and polishes a surface region of length L.

The length L is an important factor in the improvement of the polishing efficiency of the cooling roll at the contact edges (ribbon edges) where the amount of surface damage is large.

The inventors produced amorphous ribbon while conducting online polishing with polishing members having suitable polishing properties. The production was repeated at different contact lengths of the polishing members with the circumferential surface of the cooling roll (hereinafter sometimes called the "polishing length") L and the surface roughness of the cooling roll was measured at the contact edges (ribbon edges), where the amount of damage was greatest, and at the middle region, where the amount of damage was smallest. FIG. 2(*b*) shows the results obtained when two polishers spaced in the direction of cooling roll rotation were used. From FIG. 2(*b*) it can seen that roughness difference between the contact edges (ribbon edges) and the middle region could be substantially eliminated and smoothing achieved by making the contact length (polishing length) L equal to or greater than 0.2% of the circumference of the cooling roll. The present invention therefore defines the contact length (polishing length) L of the polisher as 0.2% or greater of the circumference of the cooling roll.

Thus, in the course of the amorphous ribbon production, in order to ensure that the circumferential surface of a cooling roll sustaining different amounts of damage in its lateral direction maintains a prime surface finish throughout its lateral direction, the present invention conducts polishing of the circumferential surface of the cooling roll after peeling of the amorphous ribbon in a manner that differentiates the polishing mode of the polishing member in accordance with the surface properties of the cooling roll circumferential surface. This is a characterizing feature of the present invention.

Further, in the present invention, in order to ensure that the circumferential surface of the cooling roll sustaining different amounts of damage in its lateral direction maintains a prime surface finish throughout its lateral direction, it is preferable to:

(i) install at least two polishing members having different polishing characteristics spaced apart in the direction of cooling roll rotation, and (ii) conduct polishing with the polishing members in contact with the circumferential surface of the cooling roll over a length equal to 0.2% or greater of the cooling roll circumference.

This is because, in the lateral direction of the cooling roll, the amount of surface damage is greater at and near the contact edges (ribbon edges) than at the middle region. Although it follows from this that the coarseness can be maintained uniform in the lateral direction of the cooling roll by polishing throughout the lateral direction to a degree equal to or greater than the damage of the contact edges (ribbon edges), this method makes the surface of the cooling roll too rough, thereby degrading the magnetic properties of the ribbon produced. It is therefore necessary to finish the cooling roll to about the same roughness as before it was damaged using one or more polishing members capable of polishing the damaged contact edges (ribbon edges) and the damaged middle region to the desired level of roughness.

When amorphous ribbon is produced using the single-roll method, molten alloy contacts and solidifies on the cooling roll every revolution. The surface of the cooling roll is therefore damaged once every turn by the thermal contraction occurring at the time of solidification. When a polishing member or members are installed on the circumferential surface of the cooling roll for maintaining the circumferential surface of the cooling roll in prime condition, each polishing member contacts and polishes any given location in the direction of rotation once per revolution. Therefore, in order to maintain the cooling roll circumferential surface in prime condition using one or more polishing members differing in polishing characteristics that can achieve polishing of the desired roughness level, it is necessary to enhance the polishing efficiency by a single contact per cooling roll revolution.

In their search for an efficient polishing method, the inventors discovered that rather than installing multiple or wide-area polishing materials of the same characteristics, use of a combination of polishing materials differing in polishing characteristics is better from the aspects of realizing a marked improvement in polishing efficiency and enabling substantial maintenance of the initial cooling roll surface condition uniformly across the cooling roll lateral direction up to the completion of amorphous ribbon production.

They further learned that to maintain the cooling roll substantially in its initial surface condition, one of the polishers must contact the circumferential surface of the cooling over 0.2% or greater of the circumference thereof. Specifically, it was found that when the contact length expressed in percent is less than 0.2%, the polishing efficiency declines and cooling roll damage gradually increases.

The present invention will be explained with reference to the drawings. FIGS. 3(*a*) to 3(*c*) show configuration of single-roll apparatuses for manufacturing amorphous ribbon in accordance with the present invention.

The single-roll apparatus shown in FIG. 3(*a*) continuously produces an amorphous ribbon 6 by bringing the opening surface of a nozzle 3 adjacent to the circumferential surface of a cooling roll 5 rotating at high speed and ejecting molten alloy 2 contained in a tundish 1 from the nozzle 3.

Production of the amorphous ribbon 6 commences when a stop 4 located in the tundish 1 is raised to eject the molten alloy 2 onto the circumferential surface of the cooling roll 5 and the produced amorphous ribbon 6 is coiled on a take-up roll 7*a*.

As shown in FIG. 3(*a*), the single-roll apparatus has another take-up roll 7*b* standing by near the amorphous ribbon. When the designated amount of ribbon has been wound on the take-up roll 7*a*, the amorphous ribbon 6 is cut (cutter not shown) and winding on the next take-up roll 7*b* is begun.

After the take-up roll 7*a* has been wound with the designated amount of amorphous ribbon, a roll changer (not shown) replaces it with a fresh take-up roll. Coiling is then continued with the new take-up roll, which is also rotated by a carrousel reel 8, so that amorphous ribbon can be produced over a prolonged period.

The circumferential surface of the cooling roll 5 from which the amorphous ribbon 6 has been peeled is polished online by polishers 9 in contact with the cooling roll circumferential surface. As explained earlier, the present invention differentiates the polishing method (polishing mode) across the circumferential surface in the lateral direction of the cooling roll.

The factor(s) differentiating the polishing mode can be established by appropriately selecting from among one or more of the material, shape, abrasive grit size, hardness, density (number of polishing elements per unit area), contact area, and pressing force of the polishing member by location in the lateral direction of the cooling roll. However, the polishing-mode-differentiated polishing member should preferably have polishing characteristics that can maintain the required contact length L over a long period of time.

Figure 4:
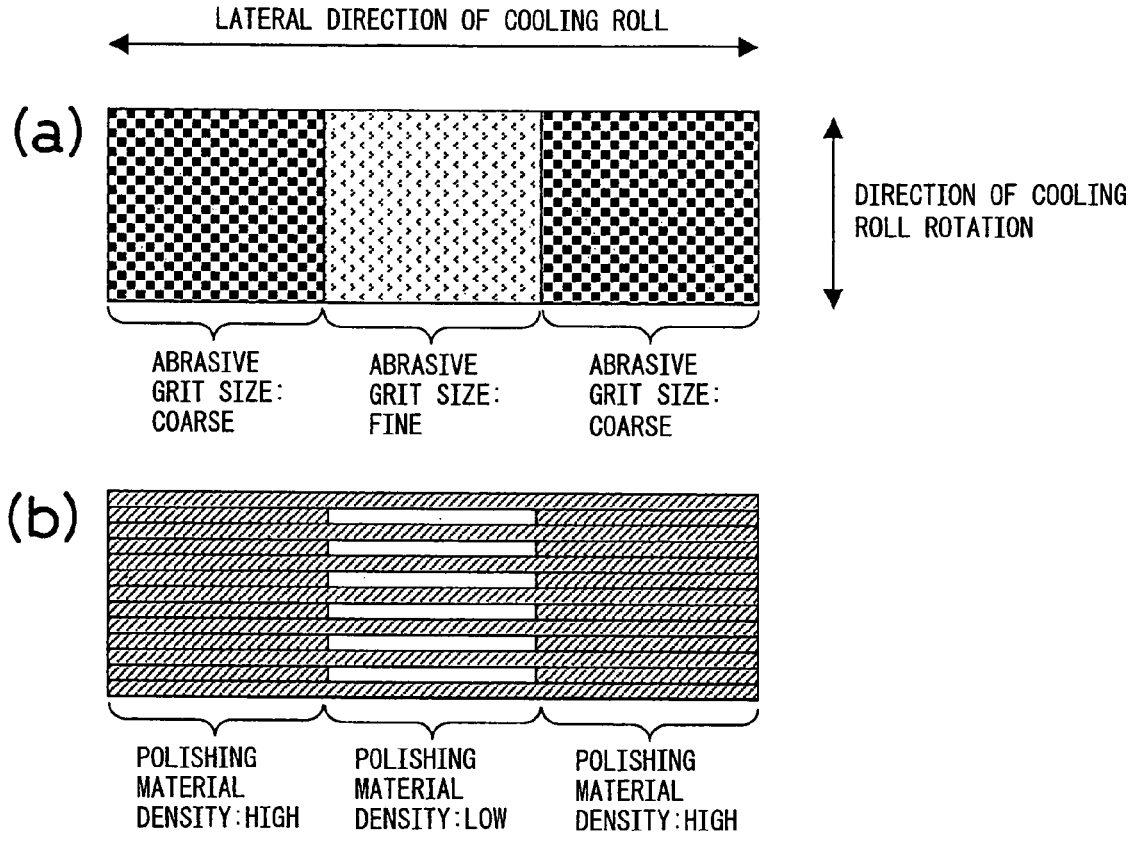
FIG. 4 is a set of diagrams showing configurations of polishers whose polishing modes are differentiated across the lateral direction of the cooling roll circumferential surface, in which (a) shows an abrasive grit size differentiation configuration and (b) shows a polishing material density differentiation configuration.

FIG. 4 shows how polishing mode can be changed across the lateral direction of the circumferential surface of the cooling roll. The polishing member is segmented into a middle region and opposite edge regions and polishing materials having different polishing characteristics are positioned at the middle and edge regions.

As explained earlier, the amount of damage sustained by the cooling roll varies in the lateral direction of the cooling roll, with the damage at and near the contact edges (ribbon edges) being greater than that at the middle region. The polishing member therefore requires polishing characteristics whereby the polishing power of its opposite end regions that polish the contact edges (ribbon edges) and vicinity is greater than the polishing power of its middle region.

However, the surface roughness of the cooling roll must be kept to a level that does not degrade the properties of the amorphous ribbon. It is therefore necessary to determine a suitable polishing member by conducting tests beforehand.

FIG. 4(*a*) shows a case in which the polishing power at the opposite edge regions that polish the contact edges (ribbon edges) and vicinity is made greater than the polishing power at the middle region by changing the abrasive grit size of the polishing member while keeping its density the same (changing the grit size of the polishing member), specifically a configuration in which the abrasive grit size of the middle region is made fine and that of the opposite edge regions is made coarse.

FIG. 4(*b*) shows a case in which the polishing density of the polishing member is changed while keeping its abrasive grit size the same, specifically a configuration in which the polishing density of the middle region is made low (sparse) and that of the opposite edge regions is made high (dense).

Although FIG. 4 shows the polishing state in the case of differentiating the polishing mode between segment regions, i.e., the middle region and the opposite edge regions, the width of the segments can be suitably determined in light of the pattern of the damage in the lateral direction of the cooling roll and segmentation for forming additional polishing characteristic regions can itself be determined in light of the pattern of the damage in the lateral direction of the cooling roll. For example, the width of the middle region segment can be made relatively narrow and the opposite end regions each be subdivided into two regions differing in polishing state.

It suffices for the polishing member to be constituted in a shape or of a material or the like that enables differentiation of the polishing mode in the lateral direction of the circumferential surface of the cooling roll. While no particular restriction is placed on the polishing member, a cylindrical brush roll, linear brush, cup brush or the like is preferable in the point of enabling desired regulation of the polishing state and maintenance of the polishing state over a long period, while preferable polishing materials are ones that are softer than the cooling roll surface hardness and are of a material highly resistant to frictional wear from the cooling roll surface, such as ones constituted by braiding abrasive grains into a resin fiber rod, by coating or adhering adhesive grains onto a resin fiber rod, or by kneading abrasive grains into a resin fiber rod. In addition, as readily available polishing members it is possible to adopt an abrasive pad, abrasive paper, abrasive belt or the like. Further, the polishing member can be oscillated in the lateral direction of the cooling roll in order to enhance the uniformity of the polishing finish.

As explained earlier, it is important that the polishing characteristics and polishing state of the polishers 9*a* and 9*b* installed for enhancing polishing efficiency be differentiated in the direction of rotation of the cooling roll. Specifically, in the single-roll apparatus shown in FIG. 3(*a*), even if the polisher 9*b* is constituted of the same type member as the polisher 9*a*, its polishing characteristics must be differentiated from the polishing characteristics of the polisher 9*a*. The polishing characteristics of the polisher 9*b* are of course specified in accordance with the properties of the circumferential surface of the cooling roll polished by the upstream polisher 9*a*.

When a brush roll or other roll-shaped polishing member is used, the polishing member is preferably rotated for prolonged maintenance of the polishing characteristics. In such case, the direction of rotation can be either forward or reverse relative to the direction of cooling roll rotation. A suction unit for collecting polishing dust generated by the polishing is preferably installed near the brush roll.

As the polisher of the final stage, it is possible, as shown in FIG. 3(*b*), to adopt a unit 9*c* for pressing the polishing member directly onto the circumferential surface of the cooling roll. Preferable polishing members include, for example, an abrasive pad or an abrasive paper or abrasive belt equipped with a mechanism capable of continuously supplying a fresh polishing surface.

The abrasive pad or abrasive belt functions to conduct cleaning simultaneously as it polishes the circumferential surface of the cooling roll and is therefore preferably installed after the polishing member (9*a* in FIG. 3(*b*)) in contact with the circumferential surface of the cooling roll over contact length L.

Regarding the polishing member 9*c*, still more preferable for securing the designated contact length is to give it a shape matching the outer surface of the cooling roll or to enable its deformation to match the outer surface of the cooling roll by providing a soft rubber pressing mechanism or the like.

Moreover, the amount of damage of the circumferential surface of the cooling roll is measured online and the polisher is continuously or intermittently contacted with the circumferential surface of the cooling roll based on the measurement results.

Figure 5:
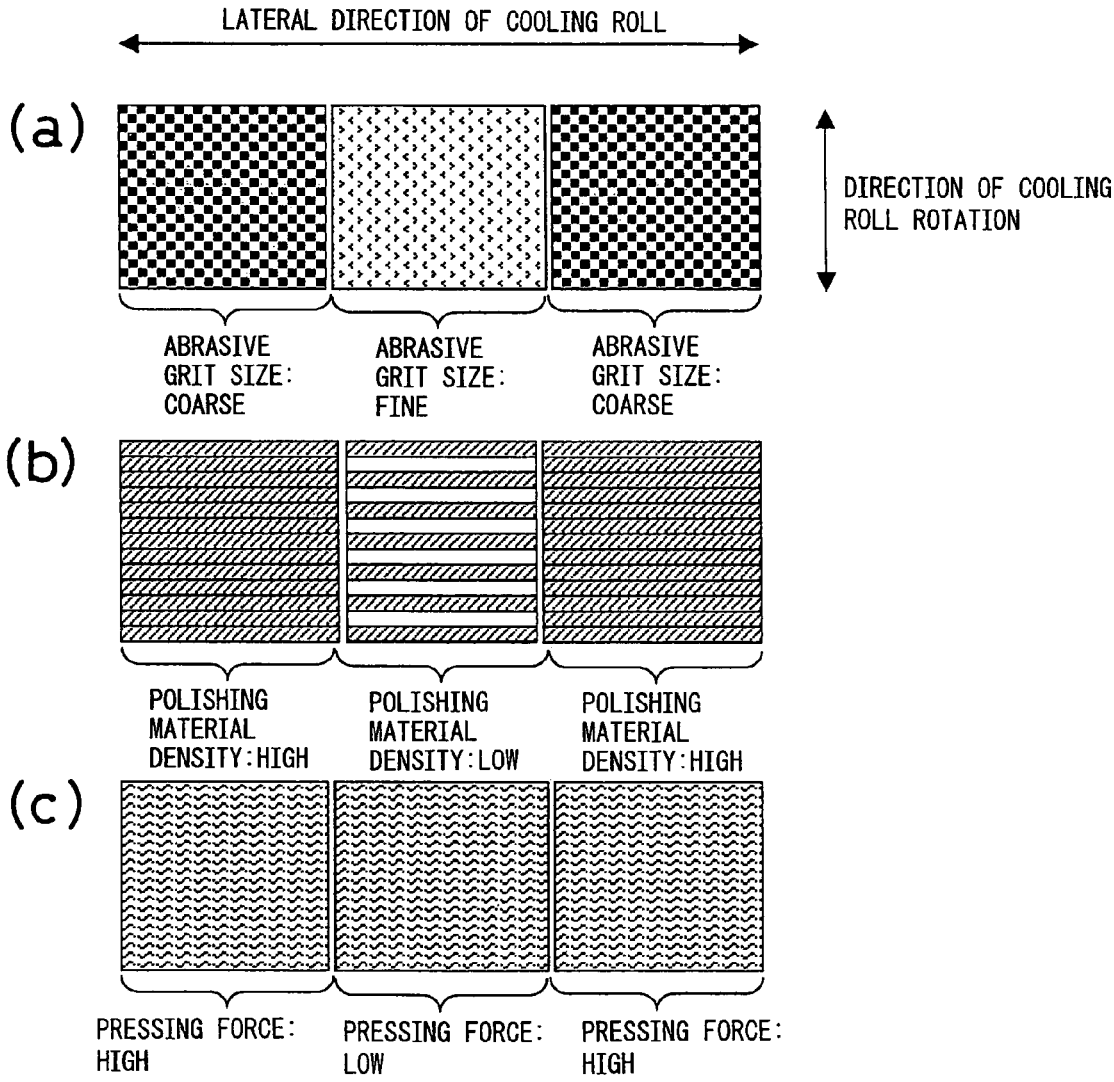
FIG. 5 is a set of diagrams showing other configurations of polishers whose polishing modes are differentiated across the lateral direction of the cooling roll circumferential surface, in which (a) shows an abrasive grit size differentiation configuration, (b) shows a polishing material density differentiation configuration, and (c) shows pressing force differentiation.

FIG. 5 shows other configurations of polishing members for conducting polishing across the lateral direction of the cooling roll circumferential surface. As shown in FIG. 5, the polishing members can be segmented in the lateral direction of the cooling roll and arranged in parallel.

In the polishing configuration of FIG. 5(*a*), the polishing state is differentiated in the lateral direction of the cooling roll by making the abrasive grit size of the middle polisher fine and the abrasive grit size of the opposite end polishers coarse.

In the polishing configuration of FIG. 5(*b*), the polishing state is differentiated in the lateral direction of the cooling roll by making the polishing material density of the middle polisher low and the polishing material density of the opposite end polishers high.

In the polishing configuration of FIG. 5(*c*), although the middle and opposite end polishers are the same, the polishing state is differentiated in the lateral direction of the cooling roll by making the pressing force of the middle polisher low and the pressing forces of the opposite end polishers high.

It is worth noting that also in the case of subdividing the polishing member into segments, the number of segments is not limited to three as shown in FIG. 5 but can be suitably selected in accordance with the amounts and distribution of damage in the lateral direction of the cooling roll.

And also in the case where the polishing member is subdivided, it is possible to measure the amount of damage of the circumferential surface of the cooling roll online and based on the measurement results to continuously or intermittently bring the polishing member segments into contact with the circumferential surface of the cooling roll unitarily or individually.

Further, the polishing member segments can be oscillated in the lateral direction of the cooling roll in order to make the transition between polishing modes at the polishing member segment boundaries gradual.

When the polishing mode is differentiated using a subdivided polisher, polishing of the cooling roll circumferential surface may sometimes be inadequate at the boundaries between the polishing member segments. In such a case, or when the polishing is inadequate throughout the lateral direction, the problem can be overcome by, as shown in FIGS. 6 to 8, conducting stepwise polishing using polishing member segments 9*x* and 9*y* installed in multiple stages to overlap partially or wholly in the circumferential direction of the cooling roll.

Figure 6:
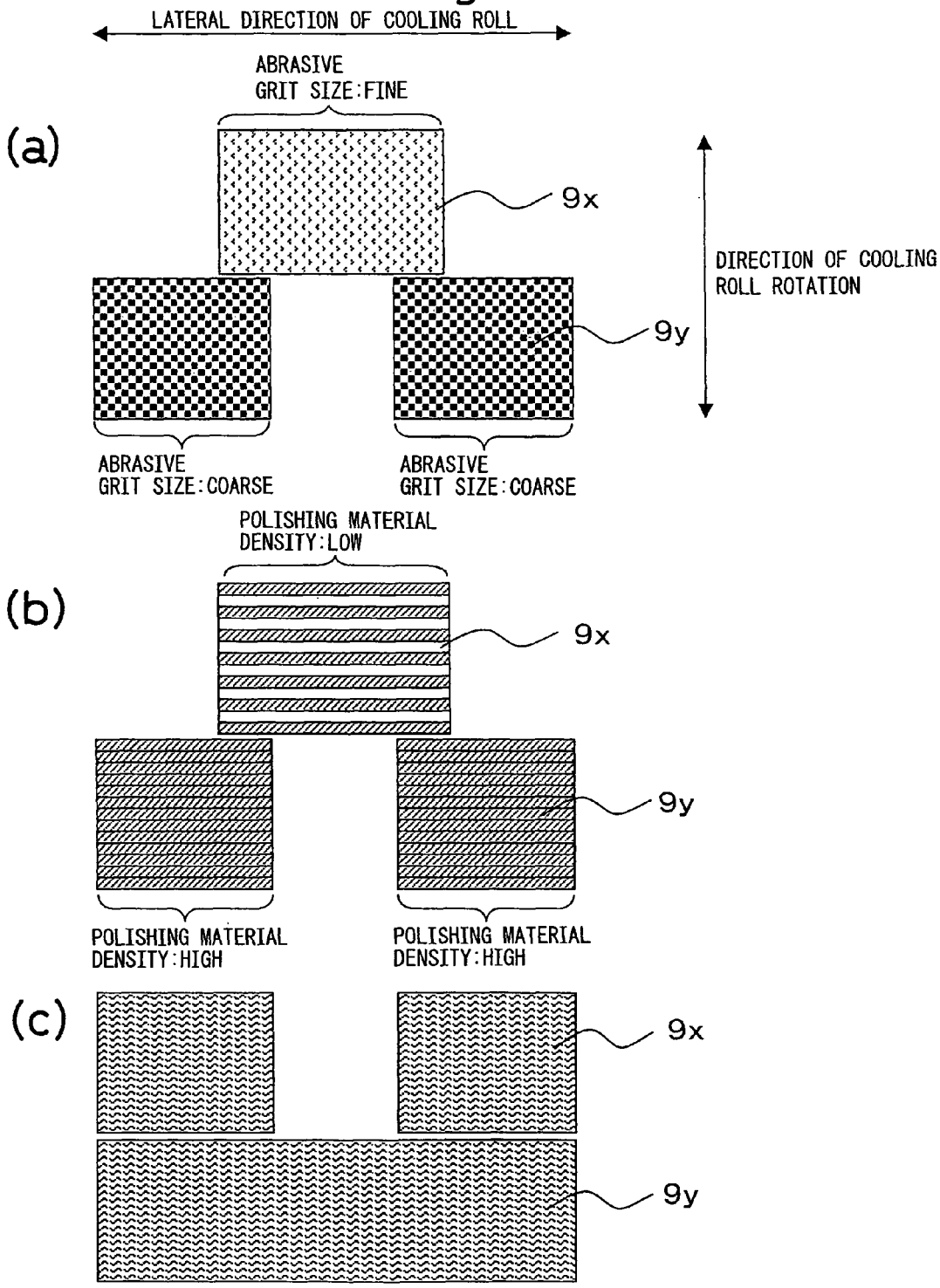
FIG. 6 is a set of diagrams showing other configurations of polishers whose polishing modes are differentiated across the lateral direction of the cooling roll circumferential surface, in which (a) shows a configuration for two-stage polishing with an abrasive grit size differentiation, (b) shows a configuration for two-stage polishing with polishing material density differentiation, and (c) shows a configuration for two-stage polishing with contact area differentiation.
Figure 7:
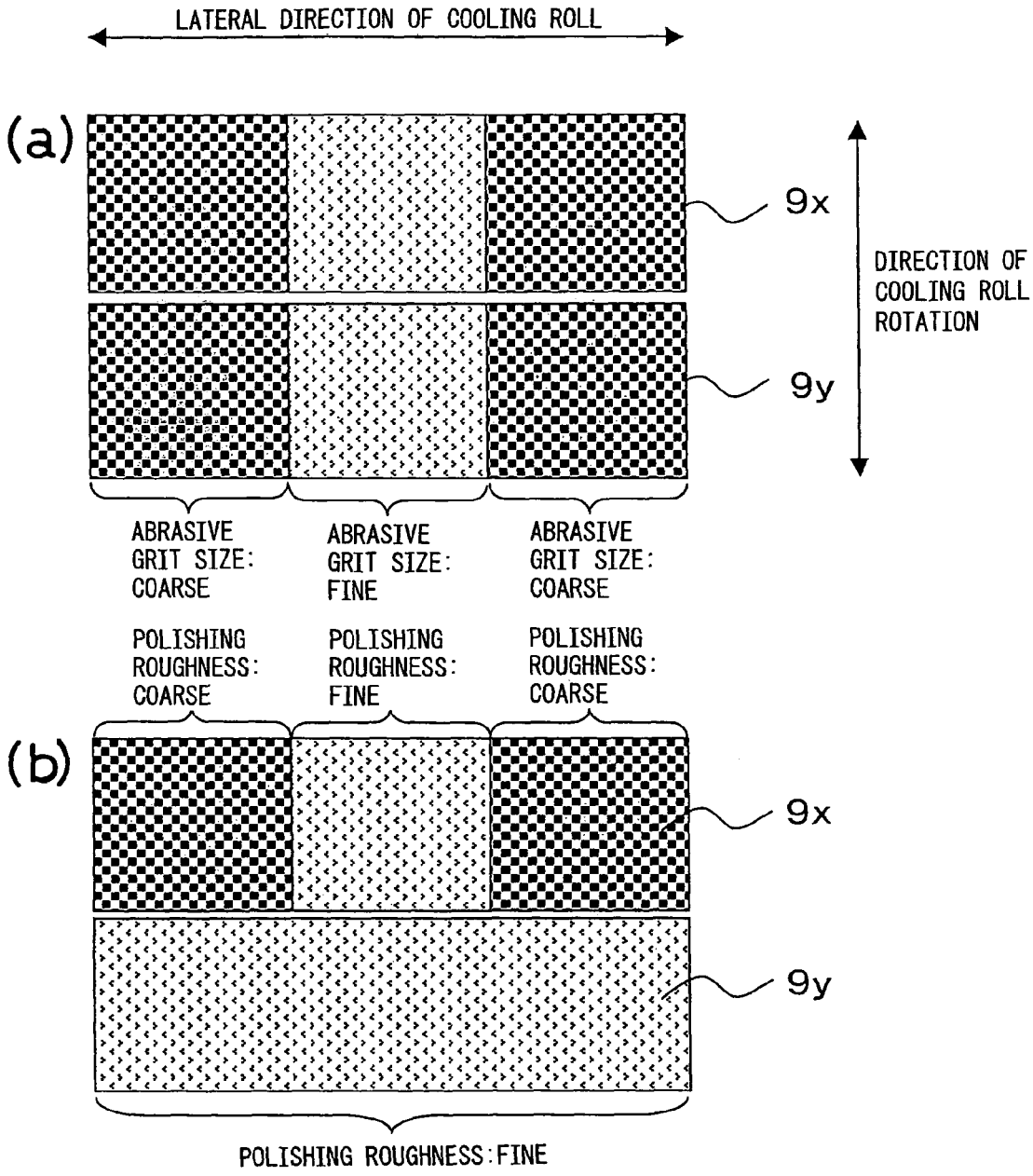
FIG. 7 is a set of diagrams, in which (a) shows an example provided with multiple polisher stages differentiated in polishing mode in the lateral direction of the circumferential surface the cooling roll (b) shows an example provided with a polisher differentiated in polishing mode in the lateral direction of the circumferential surface of the cooling roll, which is followed by a polisher not differentiated in the lateral direction.

In the two-stage segmented polishing configuration shown in FIG. 6(*a*), the polishing roughness of the middle region polishing member segment is made fine and that of the opposite edge region polishing member segments is made coarse, thereby differentiating the polishing mode in the lateral direction of the cooling roll.

In the two-stage segmented polishing configuration shown in FIG. 6(*b*), the polishing density of the middle region polishing member segment is made low and that of the opposite edge region polishing member segments is made high, thereby differentiating the polishing mode in the lateral direction of the cooling roll.

In the two-stage segmented polishing configuration shown in FIG. 6(*c*), although the polishers are all of the same type, the polishing contact area (polishing area) at the opposite edge regions is made high by using a two stage configuration, thereby differentiating the polishing mode in the lateral direction of the cooling roll.

In the segmented polishing configuration shown in FIG. 7(*a*), polishing members differentiated in polishing mode in the lateral direction of the cooling roll like that shown in FIG. 4(*a*) are installed in multiple stages (two stages in the FIG. 7(*a*) example) in the direction of cooling roll rotation.

In the segmented polishing configuration shown in FIG. 7(*b*), multiple stages (two stages in the FIG. 7(*b*) example) are installed in the direction of cooling roll rotation, with a polishing member differentiated in polishing mode in the lateral direction of the cooling roll like that shown in FIG. 4(*a*) being followed by a polishing member that has uniform surface roughness in the cooling roll lateral direction and is therefore not differentiated in polishing mode in the lateral direction.

It is worth noting that also in the case of installing polishing members in multiple stages, the distribution, segmentation and number of stages of the polishing members can be suitably decided in accordance with the amounts and distribution of damage in the lateral direction of the cooling roll and are not limited to the distribution, three segments and two stages shown in FIGS. 6 to 8.

In this case also, it is possible to measure the amount of damage of the circumferential surface of the cooling roll online and based on the measurement results to continuously or intermittently bring the polishing members and polishing member segments into contact with the circumferential surface of the cooling roll unitarily or individually. It is also possible to oscillate the polishing member and the polishing member segments in the lateral direction of the cooling roll in order to make the transition between polishing modes at the polishing member segment boundaries gradual.

Further, from the aspect of stable production of amorphous ribbon excellent in magnetic properties, it is preferable in the present invention to install a cleaner 10 near the polishing member(s), as shown in FIG. 3(*c*), for cleaning the circumferential surface of the cooling roll by removing fine polishing dust remaining on the circumferential surface of the cooling roll after polishing.

As the cleaner for cleaning the circumferential surface of the cooling roll can be adopted, for example, a brush roll not containing polishing material that blows/sucks gas and presses a cloth or the like directly onto the cooling roll circumferential surface. As in the case of the polishers, the brush roll is desirably softer than the cooling roll surface hardness and made of a material highly resistant to frictional wear from the cooling roll surface. A cylindrical brush roll or the like made of resin fiber rod is therefore preferable.

Thus in the present invention, when, in the course of production, the polishing of the circumferential surface of the cooling roll is conducted after detachment of the amorphous ribbon, polishing is performed with the polishing state differentiated in the lateral direction of the cooling roll in accordance with the amount of damage of the cooling roll. As a result, the circumferential surface of the cooling roll can be constantly maintained in prime condition over a prolonged period.

EXAMPLES

First Set of Examples

Using a single-roll apparatus configured as shown in FIG. 3, molten Fe alloy containing, in at %, Fe: 80.5%, Si: 6.5%, B: 12% and C: 1% was jetted from a 170 mm×0.85 mm rectangular slit-shaped nozzle onto the surface of a cooling roll measuring 1,198 mm in diameter and 250 mm width to produce an Fe amorphous ribbon measuring 170 mm in width and about 30 μm in thickness. The peripheral speed of the cooling roll during production was set at 21 m/s. The production conditions are shown in Table 1.

TABLE 1

| | Production conditions | | | |
|---|---|---|---|---|
| | Polishing | Production time | Core loss (W/kg) | |
| | Member | (min) | Middle | Edge |
| Invention 1 | One stage, Not subdivided | 25 | 0.082 | 0.098 |
| Invention 2 | Two stages, Subdivided | 23 | 0.091 | 0.087 |
| Invention 3 | Two stages, Subdivided | 23 | 0.083 | 0.089 |
| Invention 4 | Two stage, Not subdivided | 26 | 0.081 | 0.079 |

TABLE 1-continued

| | Production conditions | | | |
|---|---|---|---|---|
| | Polishing | Production time | Core loss (W/kg) | |
| | Member | (min) | Middle | Edge |
| Comparative Example 1 | One stage | 24 | 0.092 | 0.152 |
| Comparative Example 2 | One stages | 27 | 0.106 | 0.162 |

In Invention Example 1, the polishing member was a resin brush roll configured as shown in FIG. 4(*a*) that measured 100 mm in outer diameter and 250 mm in length. The middle region had a length of 50 mm and abrasive grit size #1000 (JIS Standard), and opposite edge regions a length of 100 mm and abrasive grit size #500 (JIS Standard).

Invention Example 2 was configured for two-stage polishing in the manner of FIG. 6(*a*). The first stage (middle region) polisher was a resin brush roll having an outer diameter of 100 mm, length of 100 mm and abrasive grit size #1000 (JIS Standard). The second stage (opposite end region) polishers were resin brush rolls having an outer diameter of 100 mm, length of 100 mm and abrasive grit size #500 (JIS Standard).

The polishing modes of the first and second stages overlapped between 75 mm and 100 mm from the ends of the cooling roll, and the distance between the first stage and second stage brushes at the overlapped portions was 50 mm.

Invention Example 3 was configured for two-stage polishing in the manner of FIG. 6(*c*). The first stage (opposite end region) polishers were resin brush rolls having an outer diameter of 100 mm, length of 100 mm and abrasive grit size #1000 (JIS Standard). The second stage polisher was a resin brush roll having an outer diameter of 100 mm, length of 250 mm and abrasive grit size #1000 (JIS Standard). The distance between the first stage and second stage brushes was 50 mm.

Invention Example 4 was configured for two-stage polishing in the manner of FIG. 7(*b*). The first stage polisher was a resin brush roll having an outer diameter of 100 mm and length of 250 mm. The middle region of the polisher had a length of 50 mm and abrasive grit size #1000 (JIS Standard) and the opposite edge regions a length of 100 mm and abrasive grit size #500 (JIS Standard). The second stage polisher was a polishing paper having a width of 250 mm and abrasive grit size of #1000 (JIS Standard), which was equipped with a mechanism for continuously supplying a fresh polishing surface. The distance between the first stage and second stage brushes was 200 mm.

The brush rolls used in Invention Examples 1 to 4 all had the same density.

Comparative Example 1 was equipped with a resin brush roll having an outer diameter of 100 mm, length of 250 mm and abrasive grit size #1000 (JIS Standard). The polishing characteristic of the brush roll was constant in the lateral direction of the cooling roll. Comparative Example 2 was equipped with a polishing paper having a width of 250 mm and abrasive grit size of #1000 (JIS Standard), which was equipped with a mechanism for continuously supplying a fresh polishing surface.

Samples taken from the produced amorphous ribbons at the point of production completion were subdivided in the ribbon width direction and subjected to magnetic property measurement, and the results of the measurements at the middle region and the ribbon edge regions were compared. Specifically, the core losses (1.3 T, 50 Hz) of the Fe amorphous ribbon samples (25 mm wide by 120 mm long) were heat treated at 360° C.×1 h and then measured with an SST (Single Sheet Tester). The results are shown in Table 1.

As can be seen from the results shown in Table 1, the amorphous ribbons obtained in Invention Examples 1 to 4 were excellent products with no substantial difference in core loss between the ribbon middle region and the ribbon edge regions, a result attributable to the fact that the circumferential surface of the cooling roll was maintained in prime condition for a prolonged period by polishing differentiated in polishing mode in accordance with the amount and distribution of cooling roll damage in the lateral direction of the cooling roll.

In contrast, it can be seen that the amorphous ribbons obtained in Comparative Examples 1 and 2 were inferior in the core loss property of the ribbon edge regions because the polishing mode was not differentiated in the lateral direction of the cooling roll, making it impossible to maintain the circumferential surface of the cooling roll in prime condition, with heavy damage arising at the contact edges (ribbon edges) of the cooling roll.

It can be seen from the results in Table 1 that the present invention made it possible to stably mass produce Fe amorphous ribbon excellent in magnetic property for a prolonged period.

Second Set of Examples

Using single-roll apparatuses configured as shown in FIGS. 3(*a*) and 3(*b*), molten Fe alloy containing, in at %, Fe: 80.5%, Si: 6.5%, B: 12% and C: 1% was ejected from 170 mm×0.85 mm and 106 mm×0.85 mm rectangular slit-shaped nozzles onto the surfaces of cooling rolls measuring 1,198 mm in diameter and 250 mm width to produce Fe amorphous ribbon measuring 170 mm in width by about 30 μm in thickness and 106 mm in width by about 30 μm in thickness. The peripheral speed of the cooling roll during production was set at 21 m/s.

Samples taken from the produced amorphous ribbons at the point of production completion were subdivided in the ribbon width direction and subjected to magnetic property measurement, and the results of the measurements at the middle region and the ribbon edge regions were compared. Specifically, the core losses (1.3 T, 50 Hz) of the Fe amorphous ribbon samples (25 mm wide by 120 mm long) were heat treated at 360° C.×1 h and then measured with an SST (Single Sheet Tester).

The production conditions and measurement results are shown in Table 2. The polishing member 1 and polishing member 2 indicated in Table 2 were installed spaced apart in the direction of cooling roll rotation in this order.

TABLE 2

| | | Production conditions | | | | | Core loss (W/kg) | |
|---|---|---|---|---|---|---|---|---|
| | No. | Polishing member 1 | Polishing member 2 | Polish length L | Strip width (mm) | Production time (min) | Mid | Edge |
| Invention Example | 1 | Brush roll (resin) grit size #500 | Abrasive paper grit size #1000 | 0.2 | 170 | 28 | 0.093 | 0.102 |
| | 2 | Brush roll (resin) grit size #800 | Abrasive paper grit size #1000 | 0.2 | 106 | 43 | 0.095 | 0.087 |
| | 3 | Brush roll (resin) grit size #500 | Abrasive paper grit size #1000 | 0.3 | 170 | 25 | 0.094 | 0.089 |
| | 4 | Brush roll (resin) grit size #800 | Abrasive paper grit size #1000 | 0.3 | 106 | 44 | 0.093 | 0.096 |
| | 5 | Brush roll (resin) grit size #150 | Brush roll (resin) grit size #800 | 0.2 | 170 | 25 | 0.082 | 0.083 |
| | 6 | Brush roll (resin) grit size #150 | Brush roll (resin) grit size #800 | 0.3 | 170 | 23 | 0.081 | 0.079 |
| Comparative Example | 7 | Brush roll (resin) grit size #500 | Abrasive paper grit size #1000 | 0.1 | 170 | 26 | 0.095 | 0.162 |
| | 8 | Brush roll (resin) grit size #800 | Abrasive paper grit size #1000 | 0.1 | 106 | 38 | 0.093 | 0.152 |
| | 9 | Brush roll (resin) grit size #800 | Brush roll (resin) grit size #800 | 0.1 | 170 | 22 | 0.095 | 0.177 |
| | 10 | Polishing paper grit size #1000 | Abrasive paper grit size #1000 | 0.1 | 170 | 23 | 0.103 | 0.198 |
| | 11 | Polishing paper grit size #1000 | Abrasive paper grit size #1000 | 0.2 | 170 | 22 | 0.101 | 0.152 |
| | 12 | Polishing paper grit size #1000 | None | 0.3 | 170 | 20 | 0.102 | 0.154 |

As can be seen from the results shown in Table 2, the amorphous ribbons obtained in Invention Examples 1 to 6 were excellent products with no substantial difference in core loss between the ribbon middle region and the ribbon edge regions, a result attributable to the fact that the circumferential surface of the cooling roll was maintained in prime condition for a prolonged period by installing differing polishing members and establishing a contact length (polishing length) L of 0.2% or greater.

In contrast, it can be seen that the amorphous ribbons obtained in Comparative Examples 7 to 9 were inferior in the core loss property of the ribbon edge regions even though differing polishing members were installed, because the contact length (polishing length) L was 0.1% and therefore impossible to maintain the circumferential surface of the cooling roll in prime condition, with heavy damage arising at the contact edges (ribbon edges) of the cooling roll.

The amorphous ribbons obtained in Comparative Examples 10 and 11 were inferior in the core loss property of the ribbon edge regions even though the contact length was increased from 0.1% to 0.2%, because identical polishing members were used, so that prevention of damage to the contact edges (ribbon edges) of the cooling roll was impossible owing to poor polishing efficiency.

The amorphous ribbon obtained in Comparative Example 12 was inferior in the core loss property of the ribbon edge regions because only the polishing member 1 was used, so that prevention of damage to the contact edges (ribbon edges) of the cooling roll was impossible even though the contact length (polishing length) L was 0.3%.

It can be seen from the results in Table 2 that the present invention made it possible to stably mass produce Fe amorphous ribbon excellent in magnetic property for a prolonged period.

INDUSTRIAL APPLICABILITY

As set out in the foregoing, the invention method and apparatus for producing amorphous ribbon enable the circumferential surface of a cooling roll that experiences uneven damage in its lateral direction during the production to be polished online in the course of the production so as to maintain the circumferential surface in prime condition throughout its lateral length over a prolonged period, thereby enabling stable mass production of amorphous ribbon excellent in magnetic property.

What is claimed is:

1. A method for producing an amorphous ribbon, the method comprising the steps of:

ejecting and solidifying molten alloy on a circumferential surface of a rotating cooling roll;

peeling solidified alloy ribbon from the cooling roll;

polishing the circumferential surface of the cooling roll with polishing members continuously or intermittently across the cooling roll in a lateral direction of the circumferential surface of the cooling roll;

differentiating the polishing mode in accordance with surface properties of the cooling roll across the lateral direction;

aligning at least two or more of the polishing members having different polishing characteristics; and polishing in contact with the circumferential surface of the cooling roll over a length equal to 0.2% or greater of the cooling roll circumference.

2. The method for producing an amorphous ribbon according to claim 1, further comprising differentiating the polishing mode using at least two polishing members having different polishing characteristics in combination, wherein the polishing members are selected from the group consisting of a cylindrical brush roll comprising a polishing material of abrasive grains braided into a resin fiber rod, an abrasive pad, an abrasive paper, and an abrasive belt.

3. The method for producing an amorphous ribbon according to claim 1, further comprising the step of cleaning the cooling roll surface after completion of the polishing.

4. The method for producing an amorphous ribbon according to claim 2, further comprising the step of cleaning the cooling roll surface after completion of the polishing.

* * * * *